US008439109B2

(12) United States Patent
Sbordone

(10) Patent No.: US 8,439,109 B2
(45) Date of Patent: May 14, 2013

(54) SYSTEM AND METHOD FOR DEPTH MEASUREMENT AND CORRECTION DURING SUBSEA INTERVENTION OPERATIONS

(75) Inventor: Andrea Sbordone, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 402 days.

(21) Appl. No.: 12/125,949

(22) Filed: May 23, 2008

(65) Prior Publication Data

US 2009/0288835 A1 Nov. 26, 2009

(51) Int. Cl.
*E21B 47/00* (2012.01)
*E21B 19/22* (2006.01)

(52) U.S. Cl.
USPC ..... 166/250.01; 166/346; 166/352; 166/367; 166/77.1; 175/45

(58) Field of Classification Search ..... 166/250.01, 166/336, 339, 341, 346, 351, 352, 367, 368, 166/255.1–255.3, 385, 77.1, 77.2, 85.1, 241.5; 175/40, 45
See application file for complete search history.

(56) References Cited

U.S. PATENT DOCUMENTS 2,476,137 A * 7/1949 Henri-Georges Doll .. 166/254.1
3,067,519 A * 12/1962 Swift ..... 33/736
3,570,594 A * 3/1971 Hamilton ..... 166/64
4,117,600 A 10/1978 Guignard et al.
4,205,379 A * 5/1980 Fox et al. ..... 701/116
5,014,781 A * 5/1991 Smith ..... 166/66.5
5,323,856 A * 6/1994 Davis et al. ..... 166/253.1
5,351,531 A * 10/1994 Kerr ..... 73/152.54
5,469,916 A * 11/1995 Sas-Jaworsky et al. ..... 166/64
5,541,587 A * 7/1996 Priest ..... 340/854.1
5,546,672 A * 8/1996 Campbell et al. ..... 33/716
5,666,050 A * 9/1997 Bouldin et al. ..... 324/207.26
5,826,654 A * 10/1998 Adnan et al. ..... 166/250.01
5,978,739 A * 11/1999 Stockton ..... 702/6
6,065,540 A * 5/2000 Thomeer et al. ..... 166/297
6,116,345 A * 9/2000 Fontana et al. ..... 166/343
6,216,789 B1 4/2001 Lorsignol et al.
6,321,596 B1 * 11/2001 Newman ..... 73/152.45
6,359,569 B2 * 3/2002 Beck et al. ..... 340/856.3
6,386,290 B1 * 5/2002 Headworth ..... 166/346
6,450,259 B1 * 9/2002 Song et al. ..... 166/255.1
6,563,303 B1 * 5/2003 Watkins ..... 324/206
6,691,775 B2 * 2/2004 Headworth ..... 166/77.2
6,725,924 B2 * 4/2004 Davidson et al. ..... 166/250.01
6,745,840 B2 * 6/2004 Headworth ..... 166/346
6,834,724 B2 * 12/2004 Headworth ..... 166/384

(Continued)

FOREIGN PATENT DOCUMENTS

WO 00/34622 6/2000

*Primary Examiner* — Matthew Buck
(74) *Attorney, Agent, or Firm* — Matthias Abrell

(57) ABSTRACT

A technique enables determination of changes in length of a conveyance deployed between a surface vessel and a subsea installation. The technique allows information to be obtained on the relationship between length of conveyance spooled out or spooled in at a surface location and the depth and/or speed of an intervention well tool deployed in a well. The information can be used to determine the actual depth of the well tool deployed in the well for the intervention operation.

20 Claims, 4 Drawing Sheets

U.S. PATENT DOCUMENTS 6,843,321 B2 * 1/2005 Carlsen ..... 166/355
7,047,653 B2 * 5/2006 Fitzgerald ..... 33/304
7,080,689 B2 * 7/2006 Guesnon et al. ..... 166/355
7,142,985 B2 * 11/2006 Edwards ..... 702/6
7,150,324 B2 * 12/2006 Laursen et al. ..... 166/355
7,274,989 B2 * 9/2007 Hopper ..... 702/6
7,347,261 B2 * 3/2008 Markel et al. ..... 166/255.1
7,431,092 B2 * 10/2008 Haheim et al. ..... 166/343
7,685,892 B2 * 3/2010 Hoen ..... 73/862.391
7,762,338 B2 * 7/2010 Fenton et al. ..... 166/348
2003/0052670 A1 * 3/2003 Miszewski ..... 324/228
2008/0105432 A1 * 5/2008 Zemlak et al. ..... 166/336
2008/0230228 A1 * 9/2008 Askeland ..... 166/352
2009/0084546 A1 * 4/2009 Ekseth et al. ..... 166/255.1

* cited by examiner

SYSTEM AND METHOD FOR DEPTH MEASUREMENT AND CORRECTION DURING SUBSEA INTERVENTION OPERATIONS

BACKGROUND

A variety of techniques are used to perform intervention operations in subsea wells in the oil and gas industry. One technique is an "open water" technique in which a cable-type conveyance is run from a surface vessel into a subsea installation through the open water, e.g. water column, without using a riser. Typically, this type of intervention operation is limited to relatively shallow water.

In deeper water, which is often greater than 500 meters deep and often up to or above 3000 meters deep, numerous complications and challenges arise. For example, the length of conveyance moving through the water column can no longer be considered constant between the surface vessel and the subsea installation. Often, the conveyance assumes a bow-like shape due to a variety of effects including sea currents, surface vessel position and surface vessel movement. Additionally, the shape of the conveyance extending through the open water changes over the duration of the intervention operation.

Conventional cable-type conveyance operating techniques assume a known relationship between the length of the conveyance spooled out at the surface and the depth of an intervention well tool in the well. In deep, open water intervention operations, however, the relationship between conveyance movements at the surface and well tool movements within the subsea well are not necessarily known. The disconnect between surface movement of the conveyance and movement of the well tool through the well is due to the dynamic behavior of the conveyance extending through the water column and due to changes in environmental conditions.

SUMMARY

In general, the present invention provides a technique for monitoring one or more parameters, e.g. changing length, of a conveyance deployed between a surface vessel and a subsea installation. Information is obtained to establish a relationship between the length of conveyance spooled out/spooled in at a surface location and the depth and/or speed of an intervention tool deployed in a well. The information can be used to determine parameters, such as actual depth, of the intervention tool deployed in the well for the intervention operation.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
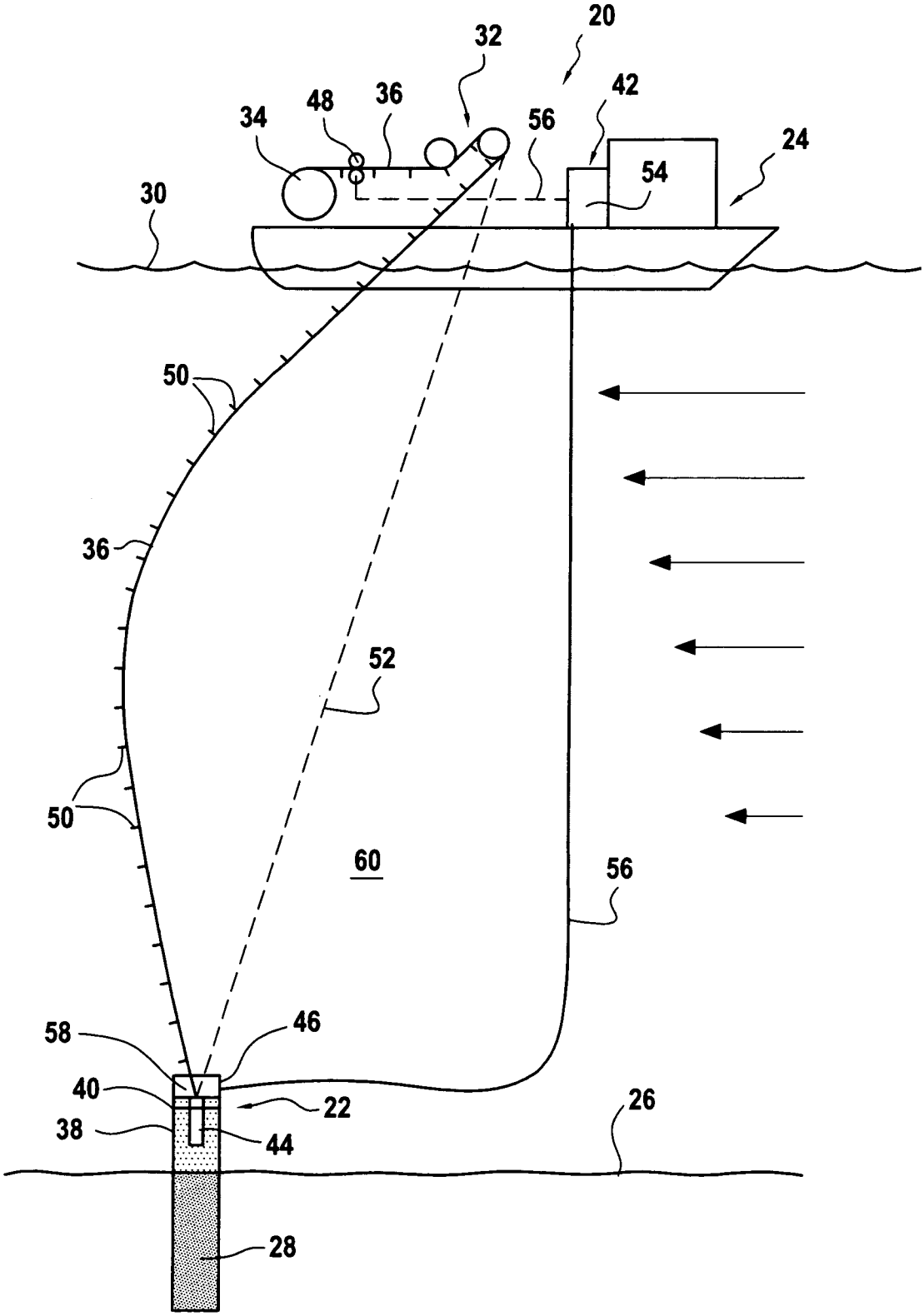
FIG. 1 is a schematic front elevation view of a subsea intervention system, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique for performing intervention operations in subsea wells. The technique relates to a depth measurement system for measuring the depth of an intervention well tool in a subsea well and a method to perform open water intervention operations. The system enables accurate depth measurements in a wide spectrum of environmental conditions and water depths.

In general, the technique enables measuring or tracking of the changing length of a conveyance that extends from a surface vessel to a subsea installation for delivering a well tool into a subsea well. Information is obtained that enables the re-establishment of a known relationship between the length and/or speed of the conveyance that is spooled out or spooled in at the surface and the depth and/or speed of the intervention tool in the subsea well. The information can be used to accurately determine (and/or correct) the actual depth measurement of the tool used in the subsea well for the intervention operation.

The system and methodology greatly improve the accuracy of the depth measurement of the well tool in the subsea well during deep, open water intervention operations. In many applications, cable-type conveyances, such as wireline conveyances or slickline conveyances, are utilized and are susceptible to various open water effects. However, the present system enables an accurate determination of the depth of the intervention tool regardless of the effects on the conveyance extending through open water between the surface vessel and the subsea installation. A subsea depth measurement system is installed in proximity to the subsea installation and is used to measure the length of conveyance entering or exiting the well at a position proximate the seabed. The subsea measurements can be combined with measurements taken at the surface to determine with improved accuracy the length of conveyance deployed at any moment between the surface vessel and the subsea installation. This allows application of corrections to improve the accuracy of the depth measurement as applied to the intervention tool string in the subsea well. The accurate measurements are obtained regardless of the trajectory of the conveyance through the water column and regardless of changes over time due to changing environmental and set up conditions.

In deep water scenarios, great forces can be applied against the conveyance and cause the spooling out of extra lengths of conveyance to compensate for the bow shape of the conveyance and to place the tool string at the required depth in the well. The necessary extra length of conveyance depends on water depth, current strength and profile, and tension applied to the conveyance. Generally, the resulting bow shape of the conveyance must be accounted for by the depth measurement system to provide an accurate measurement of the tool string position in the subsea well. Furthermore, other environmental conditions also can render it necessary to deploy different lengths of conveyance between the vessel and the subsea installation to achieve the same tool string depth within the well. If the environmental conditions change, the tool string depth also can change even without movement of the surface winch controlling deployment of the conveyance.

Examples of environmental changes affecting conveyance length and shape include tidal changes and changes of current strength, direction, and profile versus depth. However, changes in vessel position, resulting from environmental conditions or operational changes, also can affect the length and shape of the conveyance in the water column. Additionally, changes in tension on the conveyance can affect the length and shape of the conveyance extending through the water column. If an active heave compensating system is utilized, the system can drift over time which also affects the ability to accurately measure depth of the intervention well tool. The present system and methodology avoids significant depth measurement errors that otherwise can result due to these various changes.

Referring generally to FIG. 1, an intervention well system 20 is illustrated according to an embodiment of the present invention. In this embodiment, well system 20 comprises a subsea installation 22 and a surface vessel 24. The subsea installation 22 is deployed at a seabed 26 above a subsea well 28. The surface vessel 24 is positioned generally above the subsea well 28 at a surface location 30 on a surface of the sea.

Surface vessel 24 may have a variety of shapes, sizes and configurations and may include many types of equipment designed to facilitate various subsea intervention operations. For example, surface vessel 24 may comprise conveyance deployment equipment 32 having a winch 34 designed to deploy a variety conveyances, such as a conveyance 36, as illustrated in FIG. 1. In many intervention operations, conveyance 36 may comprise a cable-type conveyance, such as a wireline conveyance or a slickline conveyance. However, other types of conveyances, e.g. coiled tubing conveyances, can be used in certain intervention operations.

Similarly, subsea installation 22 may be constructed in a variety of sizes and configurations and may include many types of components. In the embodiment illustrated, subsea installation 22 comprises a lubricator 38 and a dynamic seal 40. However, the subsea installation 22 may comprise many other types of components, including seals, blowout preventers, disconnect mechanisms, various Christmas trees, and other additional or alternate components.

Intervention well system 20 further comprises a depth measurement system 42 to determine the actual depth of an intervention well tool 44, e.g. tool string, deployed in subsea well 28. Depth measurement system 42 comprises a subsea measurement system 46 located proximate the subsea installation 22. In the embodiment illustrated, for example, subsea measurement system 46 is mounted generally at the top of lubricator 38. However, subsea measurement system 46 can be positioned at a variety of other locations proximate seabed 26 and subsea well 28.

Depth measurement system 42 further comprises a surface measurement system 48 positioned at a surface location, such as a location on surface vessel 24. Both subsea measurement system 46 and surface measurement system 48 are designed to track one or more specific parameters related to conveyance 36. For example, subsea measurement system 46 and surface measurement system 48 can be designed to track the length of conveyance 36 that moves past each measurement system. The measurement systems 46, 48 also can be designed to provide signals that can be processed to determine the speed and direction of conveyance movement at the subsea and surface locations, respectively. In some applications, subsea measurement system 46 and surface measurement system 48 are designed to sense various other parameters related to use of conveyance 36 in a given intervention operation.

Movement of conveyance 36 can be tracked at subsea measurement system 46 and at surface measurement system 48 in a continuous manner by an appropriate measuring system, such as a dual wheel measuring system. Additionally or alternatively, each measurement system 46, 48 can perform depth related measurements in a discreet manner by, for example, detecting marks 50 placed along conveyance 36. By way of example, marks 50 may be sequenced by spacing the marks at specific distances, or the marks may be sequenced in patterns to provide specific indicators to subsea measurement system 46 and/or surface measurement system 48.

Several techniques can be used to mark the conveyance 36 at known intervals. For example, marks 50 may comprise magnetic marks, or marks 50 may comprise optical marks. Optical marks may comprise color bands applied on the outer surface of conveyance 36, or the optical marks can be achieved by using other localized changes along the outer surface of the conveyance so as to be detectable by optical sensing devices. However, a variety of other marking technologies also can be employed to track movement of conveyance 36 at the subsea location and the surface location.

If marks 50 are applied to conveyance 36, the subsea measurement system 46 works well when mounted in the illustrated position over lubricator 38 and in proximity to dynamic seal 40. The dynamic seal 40 contains borehole pressure by providing a seal around conveyance 36 and also provides a suitable region for detection of marks 50 by subsea measurement system 46. However, the subsea measurement system 46 can be positioned at other locations along or near subsea installation 22. It should also be noted that surface measurement system 48 can be of the same type as subsea measurement system 46, or the systems can differ in construction and/or sensing techniques. For example, surface measurement system 48 can comprise a continuous sensor system, while subsea measurement system 46 comprises a mark detection system.

Additionally, the marks 50 can be arranged in a variety of sequences or patterns to provide indicators for specific events. For example, marks 50 can constitute a sequence of short spaced marks at specific locations to indicate specific well-defined positions along conveyance 36. The sequence of short spaced marks can, for instance, indicate a specific length of conveyance that remains below the indicator marks before reaching the end of the conveyance. Such an indicator can be used to ensure conveyance movement is slow enough, for example, when the tool is moved into lubricator 38 while pulling out of the well after an intervention has been performed. The specific markings also can be used to provide an indicator for stopping winch 34 at specific depths during the intervention operation.

The marks 50 can further be employed for enabling use of subsea measurement system 46 and/or surface measurement system 48 in determining direction of conveyance movement and localized speed of the conveyance 36. For example, marks 50 can be arranged in patterns of short spaced marks and longer spaced marks with specific predetermined spacings such that the timed detection of the marks enables determination of the direction and speed of conveyance movement. Such determinations can be helpful, for example, to detect situations when the conveyance might be moving in or out of the subsea well 28 even when surface winch 34 is not operating. Similarly, the information can be used to determine if the conveyance is moving in or out of the well at a much faster or slower speed than the speed of surface winch 34. The data obtained from subsea measurement system 46 and surface measurement system 48 provide an operator with accurate positional information and speed information related to the intervention tool 44 within subsea well 28 regardless of changes affecting the portion of conveyance 36 extending through open water between surface vessel 24 and subsea installation 22. As illustrated in FIG. 1, the portion of conveyance 36 extending through the open water can vary significantly relative to the minimum distance of a straight trajectory between surface vessel 24 and subsea installation 22, as illustrated by dashed line 52.

The informational data obtained by subsea measurement system 46 and surface measurement system 48 typically is conveyed to a control system 54. Control system 54 may be a processor based control system, such as a computer control system, positioned at an accessible location. In the illustrated embodiment, control system 54 is mounted on surface vessel 24. Data is transmitted from subsea measurement system 46 and surface measurement system 48 via appropriate communication lines 56 which may be wired or wireless communication lines. For example, communication lines 56 may utilize electrical lines, optical lines, pressure pulse lines, wireless lines, combinations of these lines, or other suitable communication methods. In the embodiment illustrated, the communication line 56 extending to subsea measurement system 46 is in the form of a control umbilical routed through the open water. The type of data transferred along communication lines 56 also may vary depending on the type of sensors used in each measurement system. For example, subsea measurement system 46 may comprise a suitable sensor 58, e.g. magnetic sensor or optical sensor, to detect the presence and timing of marks 50 as those marks move past the sensor.

In one application, for example, the control system 54 is used to process the detection of a single mark 50 at the surface via surface measurement system 48 and the detection of a single mark proximate seabed 26 via the subsea measurement system 46. The two readings are compared with another set of two readings that correspond to a different mark, and this process can be repeated to provide an ongoing comparison of the movement of conveyance 36 proximate subsea installation 22 and at surface vessel 24. The control system 54 also can be used to detect two marks 50, consecutive or not, at the surface location and to compare that data to detection of the same two marks 50, consecutive or not, at the seabed location.

Figure 2:
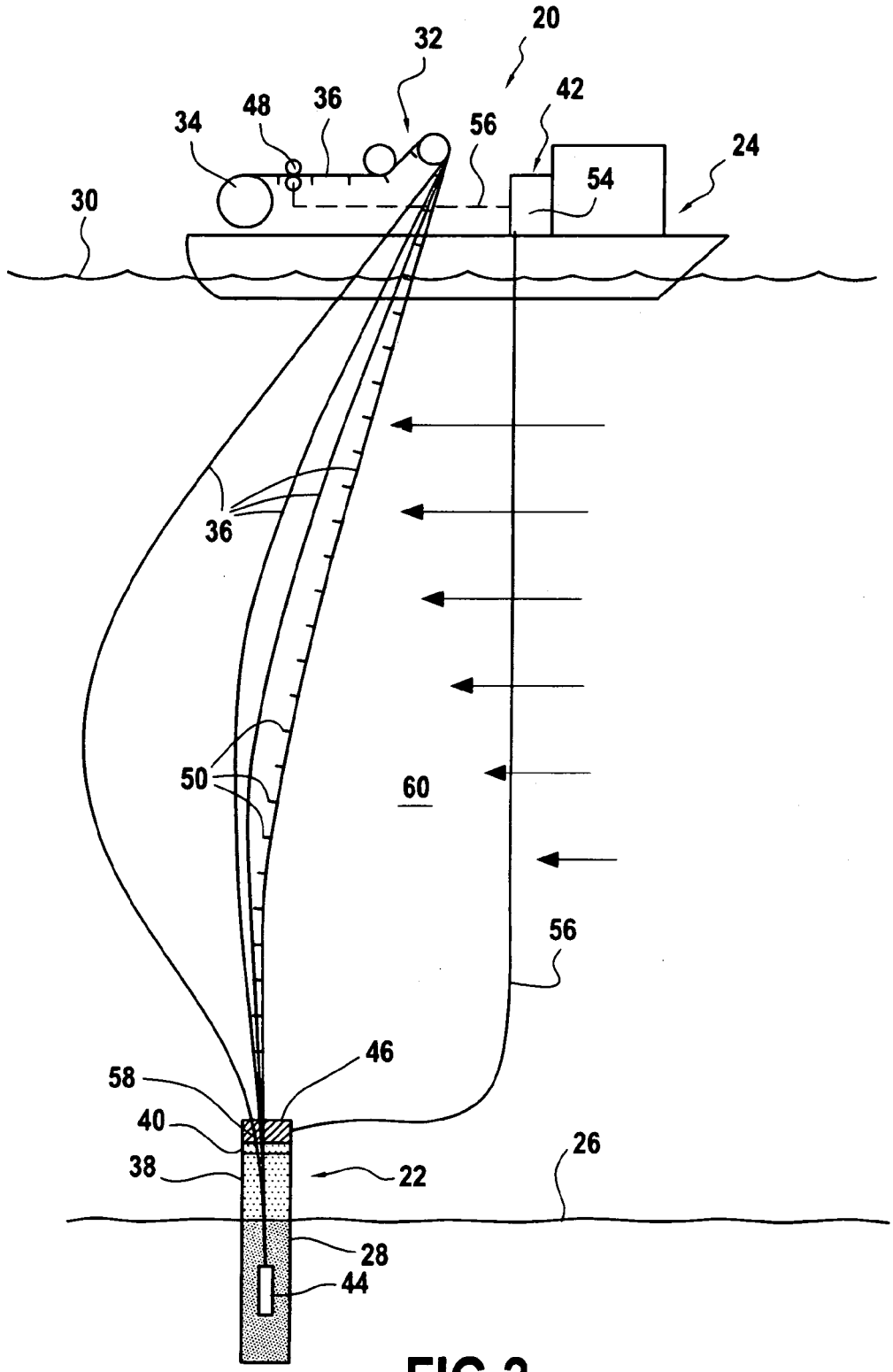
FIG. 2 is a schematic front elevation view of a subsea intervention system showing changes in the conveyance extending between a surface vessel and a subsea installation, according to an embodiment of the present invention.

Referring generally to FIG. 2, an illustration is provided to show the dynamic aspects of effects that can alter the length and shape of conveyance 36 extending through an open water region 60, i.e. water column, between surface vessel 24 and subsea installation 22. Depending on changes in tidal effects, subsea currents, surface vessel position, surface vessel movement, depth of the tool string in the well (which affects the tension on the conveyance), and other effects, the configuration of conveyance 36 can continuously change between a series of bow-like shapes, as illustrated. The control system 54 constantly monitors data received from subsea measurement system 46 and surface measurement system 48 to track changes in, for example, length of conveyance and speed of conveyance at the surface and at the subsea location. This data can be used to accurately determine differences between deployment of conveyance 36 at the surface and at the subsea installation 22, and calculation of those differences enables accurate determination of the depth of tool string 44 in subsea well 28

Figure 3:
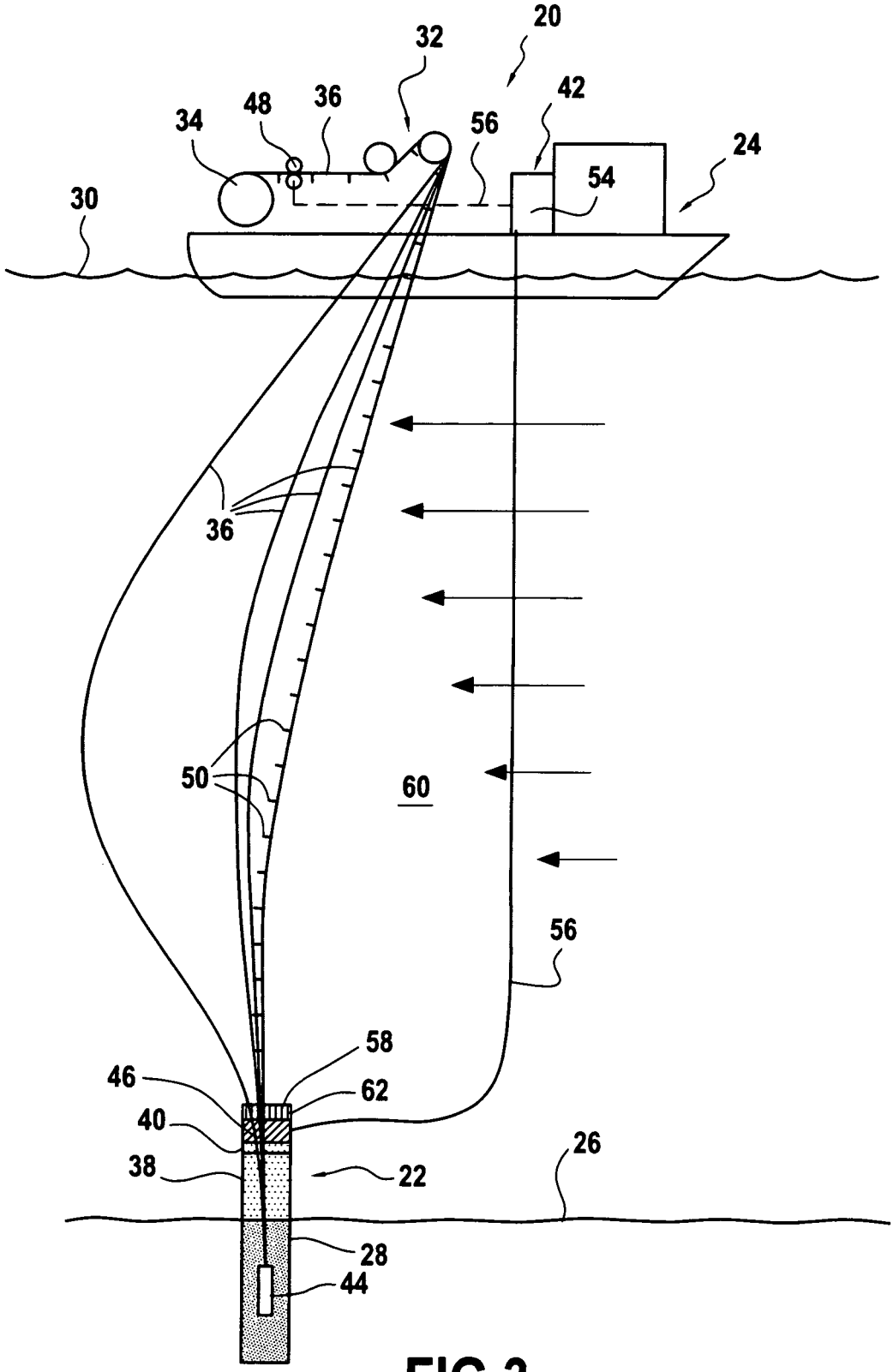
FIG. 3 is a schematic front elevation view of another example of a subsea intervention system, according to an alternate embodiment of the present invention.

The control system 54 also can be used to monitor a variety of other parameters related to deployment of conveyance 36 or related to other aspects of the overall intervention operation. As illustrated in FIG. 3, for example, the intervention well system 20 also may comprise a tension measurement system 62 used to monitor tension in conveyance 36 and to output the data to control system 54. In the illustrated embodiment, tension measurement system 62 is mounted on subsea installation 22. The tension on conveyance 36 changes as tool string 44 is deployed into subsea well 28 or withdrawn from the subsea well. The changes in tension can be used to further evaluate the configuration of conveyance 36 or to anticipate changes in conveyance configuration. Tension measurement system 62 is just one example of a variety of potential additional components and sensors that can be used in conjunction with control system 54 to facilitate the intervention operation. For example, a variety of intervention applications also incorporate a heave compensation system which may be provided on surface vessel 24 and monitored via control system 54. Control system 54, subsea measurement system 46, surface measurement system 48 and tension measurement system 62 can be used not only to determine actual depth and tension but also to determine other parameters, including actual speed and direction of movement of the tool string.

Control system 54 is used in cooperation with subsea measurement system 46 and surface measurement system 48 to evaluate a variety of data for determining characteristics of conveyance 36 and changes in those characteristics. Evaluation of this data enables accurate determination of the depth and movement of tool string 44 in subsea well 28. Although a variety of procedures and software can be used to obtain and evaluate the data, one example of a basic procedure is illustrated by the flowchart of FIG. 4.

Figure 4:
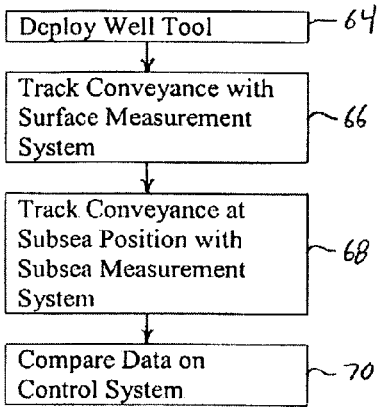
FIG. 4 is flowchart illustrating one example of a methodology for performing an intervention operation, according to an embodiment of the present invention.

In the procedure illustrated in FIG. 4, well tool 44 is initially deployed into subsea well 28, as illustrated by block 64. The movement and/or speed of conveyance 36 can be tracked during movement of the well tool 44 through open water region 60 and through subsea well 28, as illustrated by block 66. Once the well tool 44 is moved past subsea installation 22, the movement and/or speed of conveyance 36 is tracked at the subsea position with subsea measurement system 46, as illustrated by block 68. Data from both surface measurement system 48 and subsea measurement system 46 is output to control system 54 which processes and compares the data, as illustrated by block 70. The control system 54 can be programmed to process the data in a variety of ways to determine one or more parameters related to deployment of the well tool 44. The data also can be processed to facilitate evaluation of the deployment or withdrawal of conveyance 36 as well as the evaluation of various other aspects of the overall intervention operation.

Figure 5:
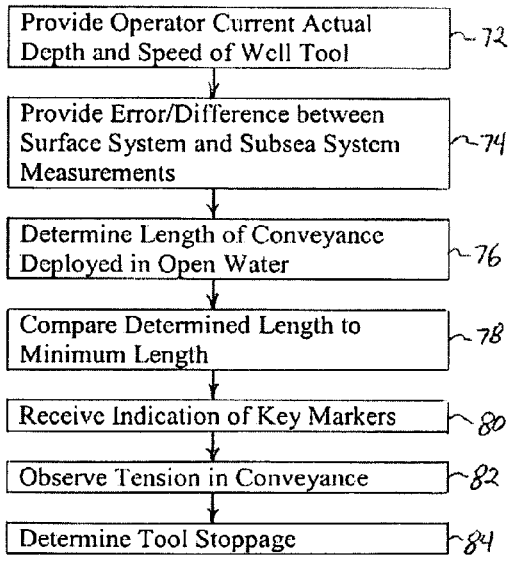
FIG. 5 is a flowchart illustrating another aspect of a methodology for performing an intervention operation, according to an embodiment of the present invention.

For example, the control system 54 can be used to process the data and output information on a series of operational parameters, as illustrated in the flowchart of FIG. 5. For example, the data can be processed to initially provide an operator with the current actual depth and speed of well tool 44, as illustrated by block 72. The data can further be used to determine any surface error with respect to the actual well tool depth by tracking the difference between surface system and subsea system measurements, as illustrated by block 74. This same data can then be used to determine the length of the portion of conveyance 36 that is deployed in the open water, as illustrated by block 76. This length, of course, can constantly change due to the dynamic effects acting on conveyance 36.

The data can further be used to provide the operator with the difference between an actual, current length of conveyance 36 deployed through water column 60 and the minimum length (see straight trajectory 52 in FIG. 1) given any offset of surface vessel 24, as illustrated by block 78. The use of marks 50 also enables the control system 54 to calibrate the monitoring of data, e.g. monitoring the length of conveyance 36 deployed in the water column, by moving the conveyance 36 at a constant speed and constant tension between at least two consecutive marks 50.

Control system 54 can further be used to raise alarms and to notify an operator when it becomes necessary or desirable to take specific actions regarding, for example, control of surface winch 34. For example, marks 50 placed along conveyance 36 can be detected as indicators of specific events or required actions, as illustrated by block 80. By way of example, short spaced marks 50 can be used as key markers to provide an indication to control system 54 of a specific event, such as the proximity of well tool 44 to lubricator 38. If tension measurement system 62 is utilized, the tension and any changes in tension can be observed and displayed to the operator, as illustrated by block 82. Additionally, data received by control system 54 can indicate movement of the conveyance at the surface but not at the entrance of the well, and this data can be used to determine tool stoppage, as illustrated by block 84. Tool stoppage can result from the tool becoming stuck or otherwise hindered within subsea well 28.

The control system 54 in cooperation with subsea measurement system 46, surface measurement system 48, and possible other sensors can be used to monitor and calculate the parameters listed above as well as a variety of other parameters as desired by the operator/programmer for a given intervention operation. Additionally, the subsea measurement system 46 and surface measurement system 48 can incorporate a variety of components and sensors used to detect marks or other indicators on a continuous or discrete basis. Additionally, the type of conveyance 36 and the type of well tool/tool string 44 can vary from one application to another. Similarly, the configuration and components of both surface vessel 24 and subsea installation 22 can be changed and adapted to accommodate specific intervention operations and environmental conditions.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for accurately determining the depth of a tool in a well during an intervention operation, comprising:
- a conveyance having a tool attached thereto, and deployed into a subsea installation;
- a subsea measurement system located proximate the subsea installation, the subsea measurement system cooperating with the conveyance to determine a parameter related to deployment of the conveyance and tool;
- a surface measurement system cooperating with the conveyance to determine the parameter of the conveyance at a surface location;
- a system to receive and compare an output from the subsea measurement system and an output from the surface measurement system to process the parameter to determine the length of conveyance deployed between the surface location and the subsea installation.

2. The system as recited in claim 1, wherein the conveyance comprises marks that can be detected by the subsea measurement system.

3. The system as recited in claim 2, wherein the marks comprise magnetic marks.

4. The system as recited in claim 2, wherein the marks comprise optical marks.

5. The system as recited in claim 2, wherein the marks are sequenced to enable determination of conveyance speed.

6. The system as recited in claim 2, wherein the marks are sequenced to enable determination of conveyance position.

7. The system as recited in claim 2, wherein the marks are arranged to enable determination of the direction of conveyance movement.

8. A method, comprising:
- deploying a well tool to a subsea well via conveyance;
- using a subsea measurement system to track deployment of the conveyance at the subsea well;
- using a surface measurement system to track deployment of the conveyance at a surface location; and
- processing output from the subsea measurement system and the surface measurement system to determine the length of conveyance deployed between the surface location and the subsea well.

9. The method as recited in claim 8, wherein using the subsea measurement system comprises mounting the subsea measurement system on a subsea installation.

10. The method as recited in claim 8, wherein using the surface measurement system comprises locating the surface measurement system on a surface vessel.

11. The method as recited in claim 8, wherein processing comprises processing output related to markings on the conveyance.

12. The method as recited in claim 8, wherein processing comprises processing length of conveyance deployed past the subsea measurement system and past the surface measurement system.

13. The method as recited in claim 8, wherein processing comprises processing speed of conveyance movement.

14. The method as recited in claim 8, wherein processing comprises processing direction of conveyance movement.

15. The method as recited in claim 11, wherein processing comprises processing a single mark at the surface measurement system with a single mark at the subsea measurement system, and subsequently processing a different mark at the surface measurement system with the different mark at the subsea measurement system.

16. A method for accurately determining the depth of a tool in a well during an intervention operation, the method comprising the steps of:
- deploying a tool string via a conveyance through a subsea installation, into a subsea well;
- deploying a surface measurement system to continuously measure movement of the conveyance;
- detecting marks on the conveyance with a subsea measurement system located proximate the subsea installation;
- using a control system to compare outputs from the subsea measurement system and the surface measurement system to determine the length of the conveyance extending through open water between a surface vessel and the subsea installation.

17. The method as recited in claim 16, wherein using the control system comprises determining tension in a conveyance coupled to the tool string.

18. The method as recited in claim 16, wherein using the control system comprises determining the actual speed.

19. The method as recited in claim 16, wherein using the control system comprises determining the actual direction of movement.

20. The system as recited in claim 16, further comprising using the control system to determine positional data related to the conveyance.

* * * * *